US006396453B2

(12) United States Patent
Amyotte et al.

(10) Patent No.: US 6,396,453 B2
(45) Date of Patent: May 28, 2002

(54) HIGH PERFORMANCE MULTIMODE HORN

(75) Inventors: Eric Amyotte, Laval; Martin Gimersky, Montreal; Aping Liang, Nepean; Chuck Mok; Ralph Pokuls, both of Beaconsfield, all of (CA)

(73) Assignee: EMS Technologies Canada, Ltd., Ste-Anne-de-Bellevue (CA)

( * ) Notice: Subject to any disclaimer, the term of this patent is extended or adjusted under 35 U.S.C. 154(b) by 0 days.

(21) Appl. No.: 09/833,713

(22) Filed: Apr. 13, 2001

Related U.S. Application Data

(60) Provisional application No. 60/198,618, filed on Apr. 20, 2000.

(51) Int. Cl.[7] ..... H01Q 13/00
(52) U.S. Cl. ..... 343/786
(58) Field of Search ..... 343/756, 772, 343/786; 333/126; H01Q 13/00, 13/02

(56) References Cited

U.S. PATENT DOCUMENTS 4,792,814 A 12/1988 Ebisui
5,486,839 A 1/1996 Rodeffer et al.
5,642,121 A * 6/1997 Martek et al. ..... 343/786
6,005,528 A * 12/1999 Preiss et al. ..... 343/786
6,020,859 A * 2/2000 Kildal ..... 343/781 CA
6,163,304 A 12/2000 Peebles et al.
6,208,309 B1 * 3/2001 Chandler et al. ..... 343/786
6,208,310 B1 3/2001 Suleiman et al.
6,211,838 B1 4/2001 Cherrette et al.

* cited by examiner

*Primary Examiner*—Tho G. Phan
(74) *Attorney, Agent, or Firm*—Holland & Knight LLP

(57) ABSTRACT

A multimode horn used to feed an antenna includes a generally conical wall for transmitting and/or receiving an electromagnetic signal there through. The wall flares radially outwardly from a throat section to an aperture and defines an internal surface having a plurality of discontinuities formed thereon and made out of electrically conductive material. The geometry of the discontinuities are configured and sized for altering the higher order mode content of the signal to achieve a balance between a plurality of performance parameters of the antenna over at least one predetermined frequency range of the signal. The discontinuities are selected from the group consisting of local smooth profile, step, corrugation and choke.

24 Claims, 5 Drawing Sheets

HIGH PERFORMANCE MULTIMODE HORN

CROSS REFERENCE TO RELATED APPLICATION

This application is related to U.S. provisional application for patent Ser. No. 60/198,618 filed on Apr. 20, 2000, now abandoned.

FIELD OF THE INVENTION

The present invention relates to a horn for use in RF signal transmitters or receivers, and more particularly to a multimode horn having higher order modes generated through discontinuities such as corrugations, smooth profiles, chokes and/or steps.

BACKGROUND OF THE INVENTION

Modern broadband high capacity satellite communication systems give rise to a host of challenging antenna design problems. High-gain Multi-Beam Antennas (MBAs) are probably the best example of such challenging antenna designs. The MBAs typically provide service to an area made up of multiple contiguous coverage cells. The current context assumes that the antenna configuration is of the focal-fed type, as opposed to an imaging reflector configuration or a direct radiating array. It is also assumed that each beam is generated by a single feed element and that the aperture size is constrained by the presence of adjacent feed elements generating other beams in the contiguous lattice.

Impact of feed performance on MBA Performance

It is well known that in order to achieve an optimal reflector or lens antenna performance, the reflector illumination, including edge-taper, needs to be controlled. FIG. 1 illustrates the EOC (Edge Of Coverage) gain of a typical MBA as a function of reflector illumination taper, assuming a $\cos_q$-type illumination. The first-sidelobe level is also shown, on the secondary axis. Depending on sidelobe requirements, FIG. 1 shows that a reflector edge-taper of 12 to 13 dB (decibels) is close to optimal. A slightly higher illumination edge-taper will yield a better sidelobe performance with a minor degradation in gain.

In multiple beam coverages, ensuring an adequate overlap between adjacent beams, typically 3 or 4 dB below peak, requires close beam spacing. In such applications where reflector or lens antennas are used and where each beam is generated with a single feed element, this close beam spacing leads to a feed array composed of tightly clustered small horns. The performance of such antennas is limited by the ability to efficiently illuminate the antenna aperture with small, closely-packed feed elements producing a relatively broad primary pattern. The main factors limiting antenna performance include:

1—High antenna spill-over losses, degrading gain performance; and

2—Limited edge illumination taper, leading to relatively high sidelobe levels.

Multiple reflectors generating sets of interleaved alternate beams have been proposed as a mean of alleviating the performance limitations described above. By using multiple apertures, the feed elements are distributed, hence the spacing and size of elements on a given feed array can be increased, resulting in a narrower, more directive, primary pattern for each feed element. The element size approximately increases as the square root of the number of apertures used. For example, interleaving the beams produced by four reflectors, as shown in FIG. 2, yields an element whose size is increased by a factor of about two (2). This greatly reduces spill-over losses and consequently improves the co-polarized sidelobe levels. The four different beam labels, identified by letters A, B, C & D in FIG. 2, refer to beams generated by the four apertures having corresponding designations.

Although multiple apertures significantly improve antenna performance by increasing the physical element size, it can be easily demonstrated that even with four apertures, the performance of MBAs employing a single feed element per beam is still limited by the aperture efficiency $\eta$ of the feed element defined as:

$$\eta = g^*(\lambda/\pi d)^2$$

where g is the peak gain, or directivity, $\lambda$ is the lowest wavelength of the signal operating frequency band and d is the physical diameter of the feed element, or feed spacing.

Assuming a $\cos^q$-type feed pattern, it can be derived that the illumination edge-taper (ET) of a four-reflector system is:

$$ET(dB) \approx 13^*\eta$$

where $\eta$ is the feed aperture efficiency. This means that for a four-reflector system, feed elements with at least 92% aperture efficiency are needed in order to achieve the 12 dB illumination taper, identified as optimal in FIG. 1. Achieving a higher edge-taper, for better sidelobe control, necessitates even higher feed aperture efficiency.

Similarly, we find that if three reflectors are used instead of four, the reflector illumination edge taper can be approximated as:

$$ET(dB) \approx 9.75^*\eta$$

In reality, the relationship between ET and $\eta$ is not exactly linear. A more rigorous analysis shows that as the edge-taper increases, the reflector size also needs to be increased in order to maintain the same beamwidth. This increase in reflector size results in a second-order increase in reflector edge-taper.

As illustrated in FIG. 3, a parametric analysis shows that the MBA gain is optimal for a feed aperture efficiency of about 95%. Selection of another beam crossover level would affect the location of the optimal point, but in general the optimal feed efficiency will always be between 85% and 100%.

Conventional solutions

It has been established that high aperture efficiency elements are required to maximize the performance of MBAs. Although conical horns offer reasonable aperture efficiency (typically between 80% and 83%), they suffer from bad pattern symmetry and poor cross-polar performance. Dual-mode or hybrid mode horns have been developed to ensure excellent pattern symmetry and cross-polar performance. Conventional dual-mode horns include the well-known Potter horn and hybrid multimode horns are usually of the corrugated type, as illustrated in FIGS. 4 and 5 respectively.

Potter horns typically offer 65–72% efficiency, depending on the size and operating bandwidth. Corrugated horns can operate over a wider band but yield an even lower efficiency, due to the presence of the aperture corrugations that limit their electrical diameter to about $\lambda/2$ less than their physical dimension.

Consequently, as shown in FIG. 3, conventional dual-mode or hybrid mode feedhorns do not allow to achieve an optimal MBA performance, since insufficient reflector edge-taper results in high sidelobe levels and a gain degraded by high spill-over losses.

OBJECTS OF THE INVENTION

It is therefore a general object of the invention to provide an improved horn that obviates the above noted disadvantages.

Another object of the present invention is to provide a multimode horn having a series of discontinuities for altering the mode content of the signal transmitted and/or received there through.

A further object of the present invention is to provide a multimode horn that alters the mode content of the signal transmitted and/or received there through via regular and/or irregular corrugation, smooth profile, choke and/or step discontinuities.

An advantage of the present invention is that the multimode horn uses the full size electrical aperture even though corrugation type discontinuities are present.

Another advantage of the present invention is that the multimode horn feeding an antenna is tailored relative to a plurality of performance parameters including at least one of the following: horn on-axis directivity, horn pattern beamwidth, antenna illumination edge-taper, antenna illumination profile and antenna spill-over losses.

Still a further advantage of the present invention is that the multibeam antenna is fed with multimode horns, each having a series of discontinuities for altering the mode content of the signal transmitted and/or received there through, to maximize the overall performance of the antenna relative to its application.

Another advantage of the present invention is that it is possible to design a multimode horn feeding an antenna that is optimized with discontinuities altering the mode content to achieve a balance between a plurality of performance parameters of said antenna over a pre-determined frequency range of said signal, thus maximizing the secondary radiation pattern and overall performance of the antenna.

Other objects and advantages of the present invention will become apparent from a careful reading of the detailed description provided herein, within appropriate reference to the accompanying drawings.

SUMMARY OF THE INVENTION

According to one aspect of the present invention, there is provided a multimode horn for either transmitting or receiving an electromagnetic signal and for feeding an antenna, said horn comprising a generally conical wall flaring radially outwardly from a throat section to an aperture, said wall defining an internal surface having a plurality of discontinuities formed thereon and made out of electrically conductive material, the geometry of said discontinuities being configured and sized for altering the higher order mode content of the signal to achieve a balance between a plurality of performance parameters of the antenna over at least one pre-determined frequency range of the signal.

Preferably, the wall and the discontinuities are made out of a single material.

Alternatively, the discontinuities are integral with said wall.

Preferably, the geometry of said discontinuities is configured and sized for altering, without the need for another component, the higher order TE mode content of the signal so as to enhance the gain thereof and/or for altering the higher order TM mode content of the signal so as to control the cross-polar content of the TE modes, therefore allowing a balance between a plurality of performance parameters of the antenna over at least one pre-determined frequency range of the signal.

Preferably, the discontinuities formed on said internal surface are generally axially symmetrical around a generally central axis of said wall.

Preferably, the discontinuities include at least one corrugation, said discontinuities further including, between said aperture and the closest one of said at least one corrugation to said aperture, a combination of different local smooth profiles, steps, and chokes, whereby said aperture is a full size electrical aperture.

Preferably, the discontinuities have an irregular profile and are selected from the group consisting of local smooth profile, step, corrugation and choke.

Preferably, at least one of the performance parameters is selected from the group consisting of horn on-axis directivity, antenna illumination edge-taper, antenna illumination profile and antenna spill-over losses.

According to a second aspect of the present invention, there is provided a method for designing and manufacturing a multimode horn for either transmitting or receiving an electromagnetic signal and for feeding an antenna, said method comprising the steps of:

a) providing a generally conical wall flaring radially outwardly from a throat section to an aperture, said wall defining an internal surface; and b) forming a plurality of discontinuities made out of electrically conductive material on said internal surface, the geometry of said discontinuities is configured and sized using a computational process for altering the higher order mode content of the signal to achieve a balance between a plurality of performance parameters of the antenna over at least one pre-determined frequency range of the signal.

Preferably, the geometry of said discontinuities is configured and sized for altering the higher order TE mode content of the signal so as to enhance the gain thereof and/or for altering the higher order TM mode content of the signal so as to control the cross-polar content of the TE modes, therefore allowing a balance between a plurality of performance parameters of the antenna over at least one pre-determined frequency range of the signal.

According to a second aspect of the present invention, there is provided a multiple beam antenna including either reflectors or lens and a plurality of multimode horns to feed the same, each of said plurality of horns generating a respective beam of said antenna and comprising a generally conical wall flaring radially outwardly from a throat section to an aperture, said wall defining an internal surface having a plurality of discontinuities formed thereon and made out of electrically conductive material, the geometry of said discontinuities being configured and sized for altering the higher order mode content of the signal to achieve a balance between a plurality of performance parameters of the antenna over at least one pre-determined frequency range of the signal.

Preferably, the plurality of horns are divided into subgroups, each of said horns forming a given subgroup have a common discontinuity pattern.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

High Performance Multimode Horn (HPMH)

In order to overcome the performance limitations obtained with conventional feed elements, a class of multimode high-efficiency elements has been developed. These high performance feed elements can be used in single-aperture multibeam antennas or combined with multiple aperture antennas to further improve their RF (Radio Frequency) performance. This high-efficiency element can achieve higher aperture efficiency than conventional dual-mode or hybrid multimode solutions, while maintaining good pattern symmetry and cross-polar performance. Single wide-band as well as dual-band designs are feasible. The basic mechanism by which the performance improvements sought can be achieved relies on the generation, within the feed element, of higher order TE (Transverse Electric) waveguide modes with proper relative amplitudes and phases.

Figure 7:
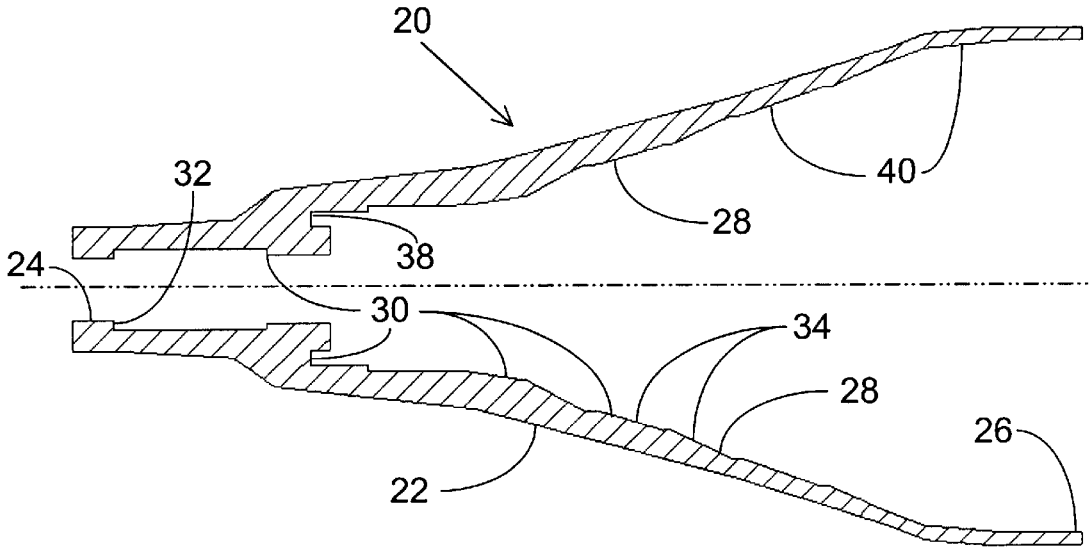
FIGS. 7, 8 and 9 are section views of three different embodiments of a HPMH according to the present invention, showing a narrow band, a dual-band and a wideband HPMHs respectively.
Figure 8:
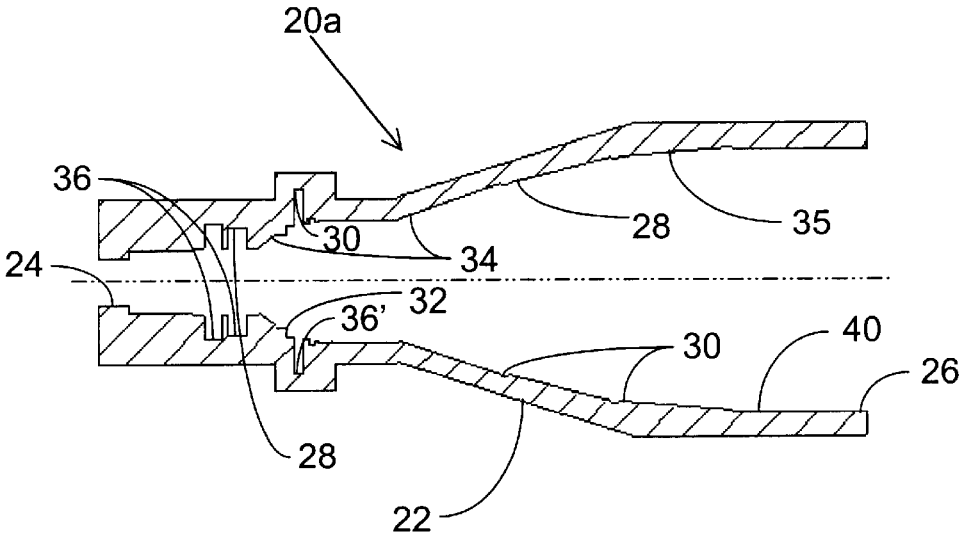
Figure 9:
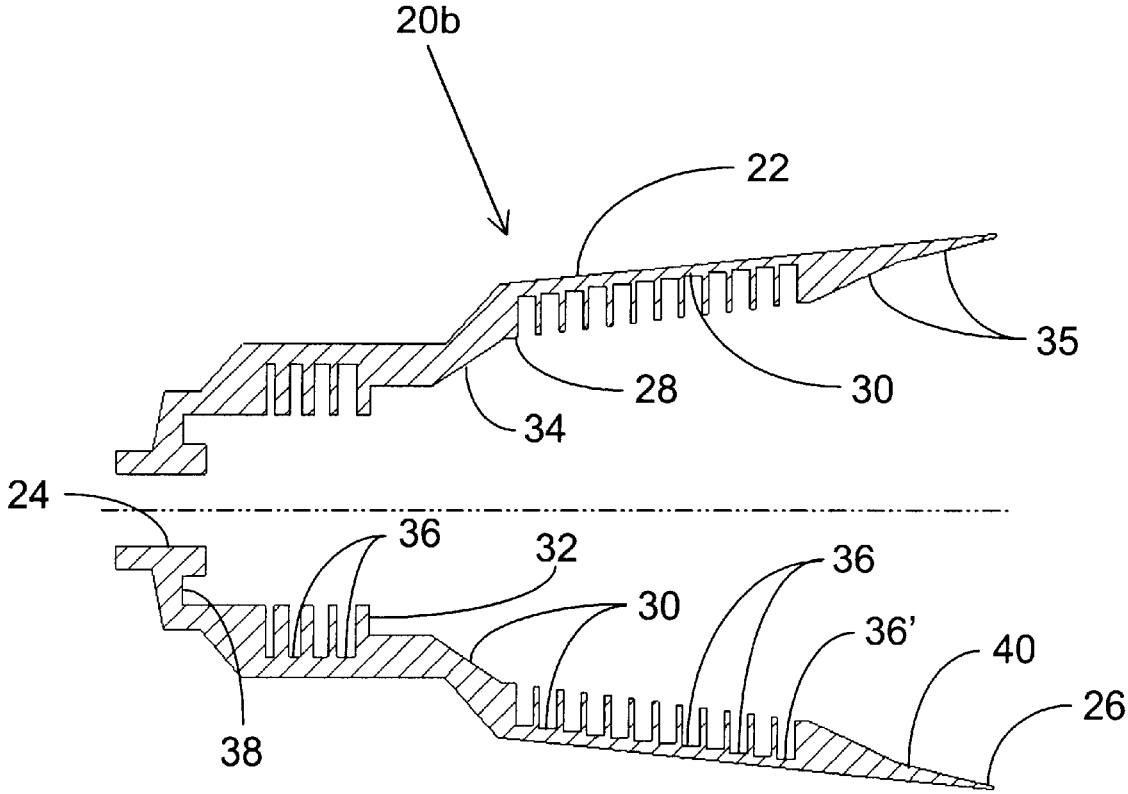

Referring to FIGS. 7 to 9, there are shown different embodiments 20, 20*a* and 20*b* of high performance multimode horns (HPMHs) according to the present invention used to improve the overall performance of their respective antenna. Each HPMH 20, 20*a*, 20*b* feeding an antenna includes a generally hollow conical structure or conical wall 22 for transmitting and/or receiving an electromagnetic signal there through. The structure 22 substantially flares radially outwardly from a throat (or input) section 24 to an aperture 26, generally of a pre-determined size, and defines an internal surface 28 having a plurality of discontinuities 30 formed thereon and designed to alter the mode content of the signal. These discontinuities 30, made out of electrically conductive material, are optimized in geometry to achieve a preferred balance (or optimization) between a plurality of performance parameters (or requirements) of the antenna over a pre-determined frequency range of the signal. When determining the discontinuities 30, at least one performance parameter is selected from the horn on-axis directivity, the horn pattern beamwidth, the antenna illumination edge-taper, the antenna illumination profile and the antenna spill-over losses is preferably considered.

The higher order TE modes are generated in the feed element or horn 22 through a series of adjacent discontinuities 30 including steps 32 and/or smooth profiles 34 and/or corrugations 36 and/or chokes 38 and/or dielectric inserts (not shown). Smooth profiles 34 located at the aperture 26 are also referred to as changes in flare angle 35. The optimal modal content depends on the pre-determined size of the aperture 26. Polarization purity and pattern symmetry requirements result in additional constraints for the modal content. The optimal feed horn structure—in terms of discontinuity type 30, quantity, location and dimensions—depends on the optimal modal content and the operating bandwidth. For example, corrugations 36 are typically used for wider operating bandwidth only.

The performance of the multimode feed 20, 20*a*, 20*b* of the present invention is therefore tailored, preferably by software because of extensive computation, to a specific set of pattern requirements of a specific corresponding application. For example, it has been found that in order to maximize the peak directivity of a horn 20, 20*a*, 20*b*, a substantially uniform field distribution is desired over the aperture 26. A nearly uniform amplitude and phase aperture field distribution is achieved with a proper combination of higher order TE modes with the dominant $TE_{11}$ mode. All modes supported by the aperture size are used in the optimal proportion. In fact, a larger aperture 26 supports more modes and provides more degrees of freedom, hence easing the realization of a uniform aperture field distribution. Only the dominant $TE_{11}$ mode is present at the throat section 24 of the horn 20, 20*a*, 20*b*. Using discontinuities 30 of various types, $TE_{1n}$ modes are generated to enhance the gain. Although modes such as $TE_{12}$ and $TE_{13}$ do not have nearly as much on-axis far-field gain parameter contribution as the dominant $TE_{11}$ mode, a higher composite gain is obtained when these modes are excited with proper amplitudes and phases. In conventional designs of feedhorns 10, 12, these higher order TE modes are usually avoided (with amplitudes near zero) because of their strong cross-polar parameter contribution. The HPMH 20, 20*a*, 20*b*, as opposed to conventional horns 10, 12, takes advantage of higher order TE modes. Furthermore, in order to cancel the cross-polar content of these modes, $TM_{1m}$ (Transverse Magnetic) modes are also generated by the discontinuities 30 in the HPMH 20, 20*a*, 20*b*. The $TM_{1m}$ modes have no on-axis co-polar gain parameter contribution but are used to control cross-polar isolation and pattern symmetry parameters. By accurately controlling the amplitude and phase of the different modes with optimized discontinuities 30, the radiating performance of the HPMH 20, 20*a*, 20*b* can be tuned with great flexibility.

Preferably, the feed/antenna performance is tailored to each specific antenna application by using all the modes available as required. The performance parameters to be optimized include, but are not limited to:

Secondary pattern gain;

Secondary pattern sidelobes;

Secondary pattern cross-polar isolation;

Primary pattern peak directivity;

Primary pattern shape;

Primary pattern cross-polar isolation;

Primary pattern symmetry;

Operating frequency band(s);

Illumination edge-taper;

Spill-over loss;

Return loss;

Horn length; and

Horn mass.

Figure 1:
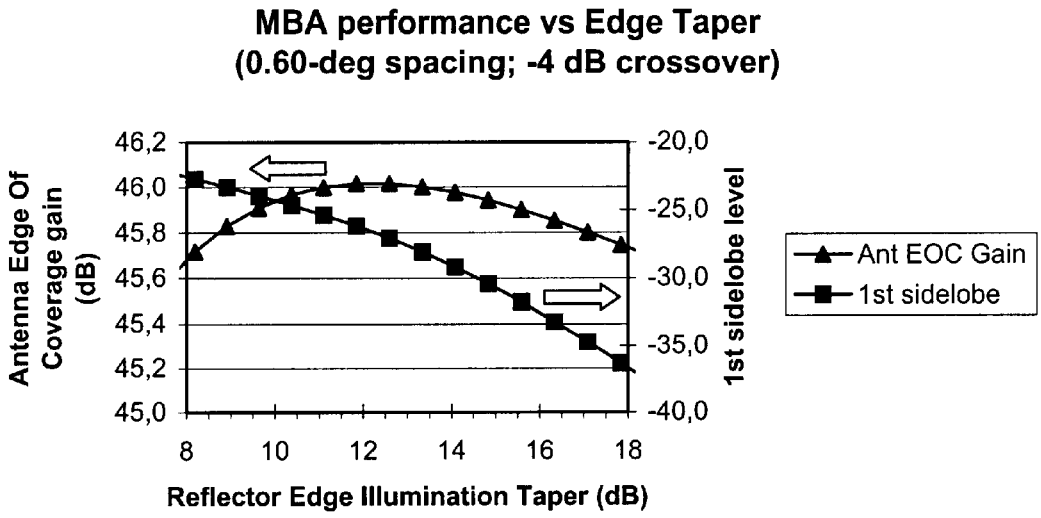
Fig. 1 (Prior Art)
FIG. 1 is a graphical illustration of a typical multibeam antenna (MBA) performance as a function of the reflector (or lens) egde-taper.
Figure 2:
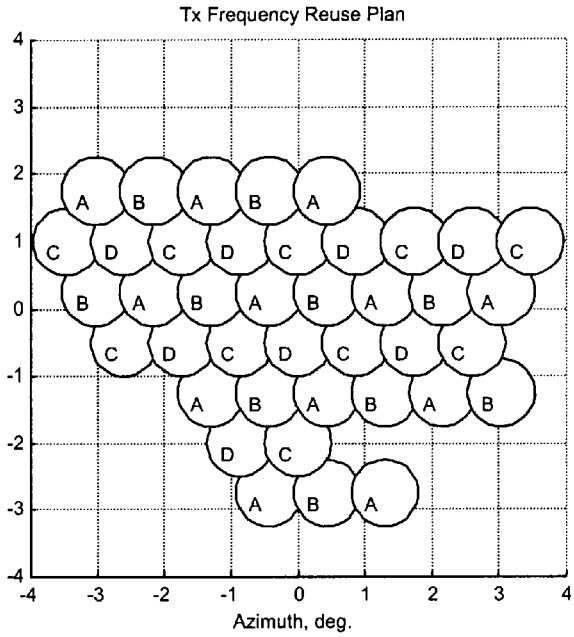
Fig. 2 (Prior Art)
FIG. 2 is a graphical illustration of a typical multibeam antenna coverage of a four aperture antenna.
Figure 3:
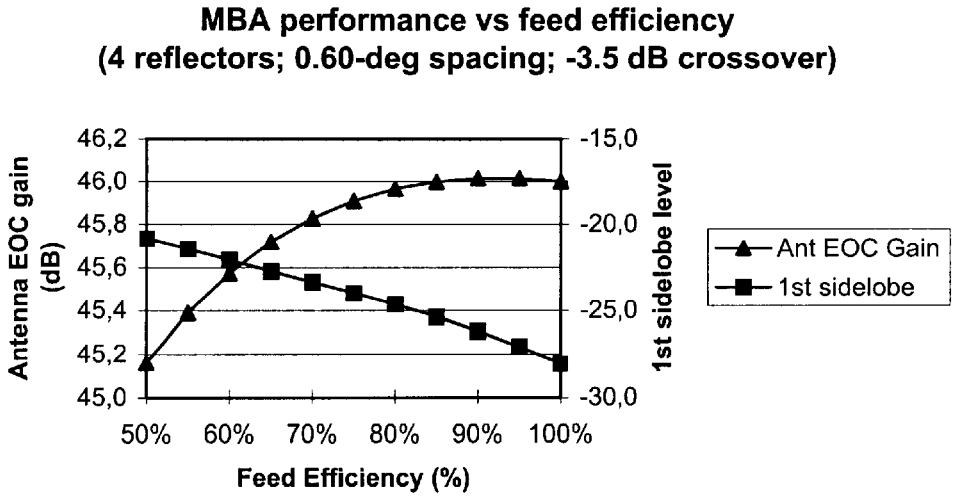
Fig. 3 (Prior Art)
FIG. 3 is a graphical illustration of a typical four aperture multibeam antenna (MBA) performance as a function of the feed efficiency.
Figure 6:
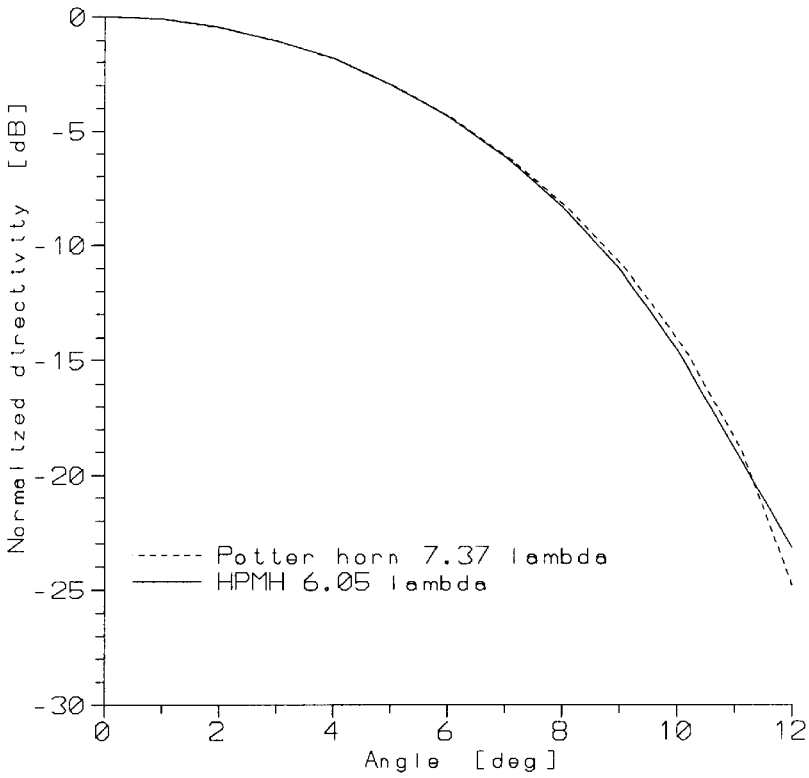
FIG. 6 is a graphical illustration of a comparison of the primary pattern between a typical dual-mode horn and a high performance multimode horn (HPMH)

For example, the HPMH 20 shown in FIG. 7 has been developed for a Ka-band frequency application for which FIG. 3 provides a parametric performance analysis. An efficiency of 92% has been achieved over the 3% operating frequency band, hence allowing for an optimal MBA performance. FIG. 6 shows a comparison between the pattern of a 6.05-λ HPMH 20 (see FIG. 7) and that of a conventional 7.37-λ Potter (or dual-mode) horn 10 (see FIG. 4). As can be seen, the diameter of the Potter horn 10 providing the equivalent edge-taper would have to be 22% larger than that of the high-efficiency radiator horn 20. The horn 20*a* depicted in FIG. 8 has been developed for another Ka-band application where high-efficiency operation over the Tx (transmit) and Rx (receive) bands, at 20 GHz and 30 GHz respectively, was required.

The high-efficiency feed element 20 performance has been successfully verified by test measurements, as standalone units as well as in the array environment. The element design is also compatible with the generation of tracking pattern while preserving the high-efficiency operation for the communications signals.

Although conventional dual-mode 10 and corrugated 12 horns also rely on a mix of different modes, there are several fundamental differences between the conventional designs 10, 12 and the new HPMH 20. These differences are in the principles of operation used to achieve the proper structure of the horn 20. They are described herebelow and also summarized in following Table 1.

Figure 4:
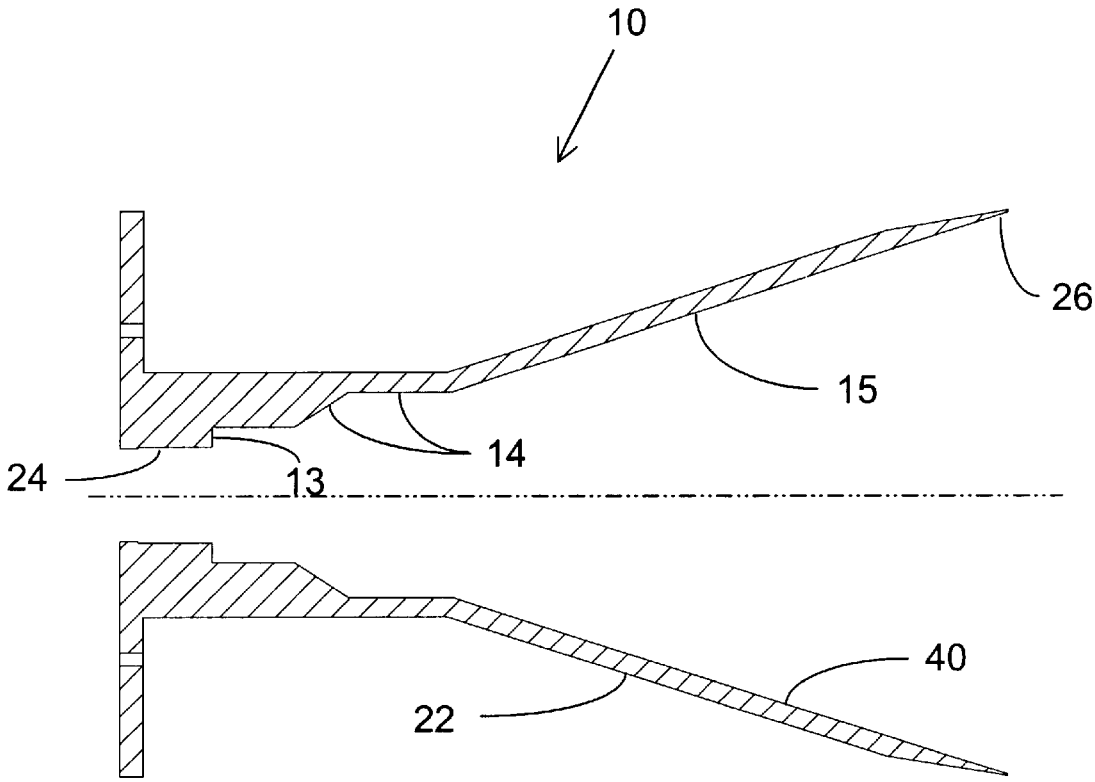
Fig. 4 (Prior Art)
FIGS. 4 and 5 are section views of a conventional dual-mode horn and a corrugated horn respectively.
Figure 5:
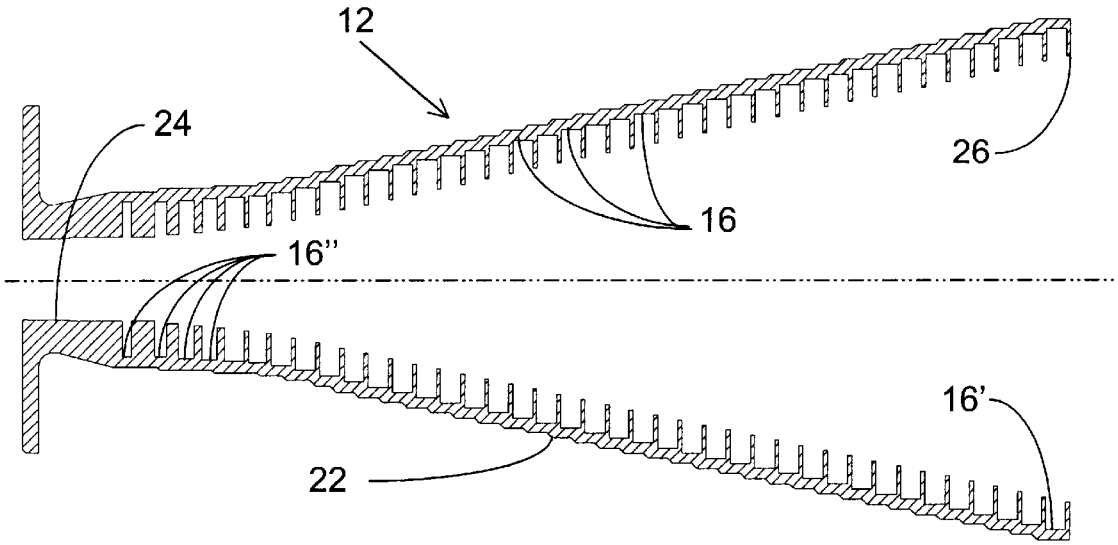
Fig. 5 (Prior Art)

Dual-mode horns 10 as shown in FIG. 4 can achieve good pattern symmetry and cross-polar performance over a narrow bandwidth (typically no more than 10% of the operating frequency band). The primary design objective of a conventional corrugated horn 12 as shown in FIG. 5 is pattern symmetry and cross-polar performance over a much wider bandwidth or multiple separate bands. In order to achieve good cross-polar performance and pattern symmetry, both the dual-mode horn 10 and the corrugated horn 12 yield relatively low aperture efficiency. The HPMH 20, 20*a*, 20*b* of the present invention can be optimized to achieve any preferred (or desired) balance between competing aperture efficiency and cross-polar parameter requirements over either a narrow bandwidth, a wide bandwidth or multiple separate bands.

Dual-mode horns 10 typically offer higher aperture efficiency than corrugated horns 12, but over a much narrower bandwidth. In contrast, the present HPMH 20, 20*a*, 20*b* can achieve either equal or better aperture efficiency than the dual-mode horn 10 over the bandwidth of a corrugated horn 12 whenever required. In essence, the HPMH 20 combines—and further improves—desirable performance characteristics of the two conventional designs of horn 10, 12 in one.

The modal content of a dual-mode horn 10 is achieved only with steps 13 and smooth profiles 14 to change the horn flare angle 15. In conventional corrugated horns 12, the desired hybrid $HE_{11}$ (Hybrid Electric) mode is generated with a series of irregular corrugations 16", and supported with a series of regular (constant depth and spacing) corrugations 16 only. The present HPMH 20, 20*a*, 20*b*, in comparison, uses any combination of regular/irregular corrugations 36, steps 32, chokes 38 and/or smooth profiles 34 to achieve the electrical performances of dual-mode 10 and corrugated 12 horns, in addition to others.

For a given inter-element spacing of a multibeam antenna, the electrical aperture (effective inner diameter) of the aperture 26 of a corrugated horn 12 is significantly smaller than that of the present HPMH 20, 20*a*, 20*b*, due to the presence of the last corrugation 16' at the aperture 26. The corrugated horn 12 electrical aperture is smaller than the diameter of the mechanical aperture 26 by twice the depth of the last corrugation 16' (the last corrugation 16' is typically $0.26\lambda_L$ deep, where $\lambda_L$ is the wavelength at the lowest frequency of operation), limiting the effective electrical aperture of the corrugated horn 12. As shown in FIGS. 8 and 9, when corrugations 36 are required, the HPMH 20*a*, 20*b* use a full size electrical aperture by having a combination of discontinuities 30 such as steps 22, smooth profiles 34 and/or chokes 38 in the output region 40 between the last corrugation 36' (closest to the aperture 26) and the aperture 26, thus fully utilizing the available diameter set by the inter-element spacing.

For multibeam antennas, all of the horns 20, 20*a*, 20*b* can be divided into a plurality of subgroups, with all horns 20, 20*a*, 20*b* of a same subgroup having the same discontinuities 30.

Depending on the specific application requirements (performance parameters), the depths and spacing of the corrugations 36 of the HPMH 20, 20*b* can be either regular or irregular, as needed. This differs from conventional corrugated horns 12, which have an irregular corrugation 16" profile to generate, and a regular corrugation 16 profile to support the hybrid modes.

Dual-mode horns 10 only use two modes (dominant $TE_{11}$ and higher order $TM_{11}$ modes) to realize the desired radiating pattern characteristics. A corrugated horn 12 is designed to support the balanced hybrid $HE_{11}$ mode over a wide bandwidth. With the HPMH of the present invention, the whole structure 22 is used to generate the optimal modal content for a maximum antenna performance of a specific application. Unlike the corrugated horn 12, the optimal result is not necessarily a mix of balanced hybrid HE modes. The profile of the multimode horn 20, 20*a*, 20*b*, the geometry of the corrugations 36 and the aperture 26 can be optimized to achieve the performance improvement sought for each specific application.

TABLE 1

Comparison of conventional and High Performance Multimode Horns

| | Dual-mode Horn 10 (ex: Potter) | Corrugated Horn 12 | High Performance Multimode Horn 20, 20a, 20b |
|---|---|---|---|
| Modal content | $TE_{11}$ and $TM_{11}$ | Balanced hybrid $HE_{11}$ mode | Multiple modes TE, TM (not necessarily balanced hybrid) |
| Discontinuity 30 for mode generation | Steps 13 and changes in horn flare angle 15 | Corrugations 16 only (irregular corrugation 16" profile to generate and regular corrugation profile to support $HE_{11}$ mode) | Corrugations 36 and/or changes in flare angle 35 and/or steps 32 and/or smooth profiles 34 and/or chokes 38 (corrugations 36 can have irregular profile.) |
| Design objectives | Excellent pattern symmetry and cross-polar performance over narrow bandwidth | Excellent pattern symmetry and cross-polar performance over wide bandwidth or multiple separate bands | High aperture efficiency, high reflector illumination edge taper and specified cross-polar performance and pattern symmetry bandwidth or N separate bands |
| Horn aperture 26 (output region 40, if applicable) | Smooth flare 15 | Corrugation 16 | Smooth flare angles 35 and/or profiles 34 and/or steps 32 and/or chokes 38 |

Although the present high performance multimode horns have been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A multimode horn for either transmitting or receiving an electromagnetic signal and for feeding an antenna, said horn comprising a generally conical wall flaring radially outwardly from a throat section to an aperture, said wall defining an internal surface having a plurality of discontinuities formed thereon and made out of electrically conductive material, the geometry of said discontinuities being configured and sized for altering the higher order mode content of the signal to achieve a balance between a plurality of performance parameters of the antenna over at least one pre-determined frequency range of the signal.

2. The horn of claim 1, wherein said wall and said discontinuities are made out of a single material.

3. The horn of claim 2, wherein said discontinuities are integral with said wall.

4. The horn of claim 1, wherein the geometry of said discontinuities is configured and sized for altering, without the need for another component, the higher order mode content of the signal to achieve a balance between a plurality of performance parameters of the antenna over at least one pre-determined frequency range of the signal.

5. The horn of claim 1, wherein the geometry of said discontinuities is configured and sized for altering the higher order TE mode content of the signal so as to enhance the gain thereof and/or for altering the higher order TM mode content of the signal so as to control the cross-polar content of the TE modes, therefore allowing a balance between a plurality of performance parameters of the antenna over at least one pre-determined frequency range of the signal.

6. The horn of claim 5, wherein the geometry of said discontinuities is configured and sized for altering, without the need for another component, the higher order TE mode content of the signal so as to enhance the gain thereof and/or for altering the higher order TM mode content of the signal so as to control the cross-polar content of the TE modes, therefore allowing a balance between a plurality of performance parameters of the antenna over at least one pre-determined frequency range of the signal.

7. The horn of claim 1, wherein said discontinuities formed on said internal surface are generally axially symmetrical around a generally central axis of said wall.

8. The horn of claim 7, wherein said discontinuities include at least one corrugation, said discontinuities further including, between said aperture and the closest one of said at least one corrugation to said aperture, a combination of different local smooth profiles, steps, and chokes, whereby said aperture is a full size electrical aperture.

9. The horn of claim 1, wherein said discontinuities have an irregular profile.

10. The horn of claim 9, wherein said discontinuities are selected from the group consisting of local smooth profile, step, corrugation and choke.

11. The horn of claim 1, wherein said discontinuities are selected from the group consisting of local smooth profile, step, corrugation and choke.

12. The horn of claim 1, wherein said at least one of said performance parameters is selected from the group consisting of horn on-axis directivity, antenna illumination edge-taper, antenna illumination profile and antenna spill-over losses.

13. The horn of claim 1, wherein said discontinuities are integral with said wall.

14. The horn of claim 13, wherein the geometry of said discontinuities is configured and sized for altering the higher order TE mode content of the signal so as to enhance the gain thereof and/or for altering the higher order TM mode content of the signal so as to control the cross-polar content of the TE modes, therefore allowing a balance between a plurality of performance parameters of the antenna over at least one pre-determined frequency range of the signal.

15. A method for designing and manufacturing a multimode horn for either transmitting or receiving an electromagnetic signal and for feeding an antenna, said method comprising the steps of:

a) providing a generally conical wall flaring radially outwardly from a throat section to an aperture, said wall defining an internal surface; and b) forming a plurality of discontinuities made out of electrically conductive material on said internal surface, the geometry of said discontinuities is configured and sized using a computational process for altering the higher order mode content of the signal to achieve a balance between a plurality of performance parameters of the antenna over at least one pre-determined frequency range of the signal.

16. The method of claim 15, wherein said wall and said discontinuities being made out of a single material.

17. The method of claim 15, wherein the geometry of said discontinuities is configured and sized for altering the higher order TE mode content of the signal so as to enhance the gain thereof and/or for altering the higher order TM mode content of the signal so as to control the cross-polar content of the TE modes, therefore allowing a balance between a plurality of performance parameters of the antenna over at least one pre-determined frequency range of the signal.

18. A multiple beam antenna including either reflectors or lens and a plurality of multimode horns to feed the same, each of said plurality of horns generating a respective beam of said antenna and comprising a generally conical wall flaring radially outwardly from a throat section to an aperture, said wall defining an internal surface having a plurality of discontinuities formed thereon and made out of electrically conductive material, the geometry of said discontinuities being configured and sized for altering the higher order mode content of the signal to achieve a balance between a plurality of performance parameters of the antenna over at least one pre-determined frequency range of the signal.

19. The antenna of claim 18, wherein said wall and said discontinuities are made out of a single material.

20. The antenna of claim 18, wherein the geometry of said discontinuities is configured and sized for altering the higher order TE mode content of the signal so as to enhance the gain thereof and/or for altering the higher order TM mode content of the signal so as to control the cross-polar content of the TE modes, therefore allowing a balance between a plurality of performance parameters of the antenna over at least one pre-determined frequency range of the signal.

21. The antenna of claim 18, wherein said discontinuities include at least one corrugation, said discontinuities further include, between said aperture and the closest one of said at least one corrugation to said aperture, a combination of different local smooth profiles, steps, and chokes, whereby said aperture is a full size electrical aperture.

22. The antenna of claim 18, wherein said discontinuities are selected from the group consisting of local smooth profile, step, corrugation and choke.

23. The antenna of claim 18, wherein said at least one of said performance parameters is selected from the group consisting of horn on-axis directivity, antenna illumination edge-taper, antenna illumination profile and antenna spill-over losses.

24. The antenna of claim 18, wherein said plurality of horns are divided into subgroups, each of said horns forming a given subgroup have a common discontinuity pattern.

* * * * *